US005149212A

United States Patent [19]

Murakami

[11] Patent Number: 5,149,212

[45] Date of Patent: Sep. 22, 1992

[54] DOT PRINTER WITH CHANGEABLE QUALITY DOT PATTERN

[75] Inventor: Atsushi Murakami, Nagoya, Japan

[73] Assignee: Brother Kogyo Kabushiki Kaisha, Nagoya, Japan

[21] Appl. No.: 670,918

[22] Filed: Mar. 18, 1991

[30] Foreign Application Priority Data

May 12, 1990 [JP] Japan ..... 2-121565

[51] Int. Cl.[5] ..... B41J 2/485

[52] U.S. Cl. ..... 400/121; 400/279; 340/735

[58] Field of Search ..... 400/121, 279, 322; 340/731, 735; 395/106

[56] References Cited

U.S. PATENT DOCUMENTS

| | | | |
|---|---|---|---|
| 4,650,348 | 3/1987 | Kaneko | 400/121 |
| 4,653,940 | 3/1987 | Katsukawa | 900/121 |
| 4,891,634 | 1/1990 | Ina | 340/731 |
| 5,020,927 | 6/1991 | Niikawa | 400/121 |

FOREIGN PATENT DOCUMENTS

| | | | |
|---|---|---|---|
| 0207798A2 | 7/1985 | European Pat. Off. | 400/121 |
| 0207788A2 | 1/1987 | European Pat. Off. | 400/121 |

*Primary Examiner*—David A. Wiecking
*Assistant Examiner*—Steven S. Kelley
*Attorney, Agent, or Firm*—Oliff & Berridge

[57] ABSTRACT

In a dot printer having a print head, a moving mechanism for laterally reciprocating the print head relative to a recording medium, a driving circuit for driving the print head, a memory for storing basic dot patterns, and a controller for reading a basic dot pattern from the memory that corresponds to input data, a printing pattern is produced by processing the basic dot pattern and controlling the moving mechanism and the driving circuit according to the printing dot pattern to print the data on the recording medium. A reference dot pattern is produced by replicating n vertical lines of the same dot arrangement as that of the dot lines of the basic dot pattern. The controller produces the printing dot pattern by omitting m dots following the head dot of each dot line, and each successive remaining dot, of the reference dot pattern consisting of successive dots.

7 Claims, 5 Drawing Sheets

FIG.4 ( c )
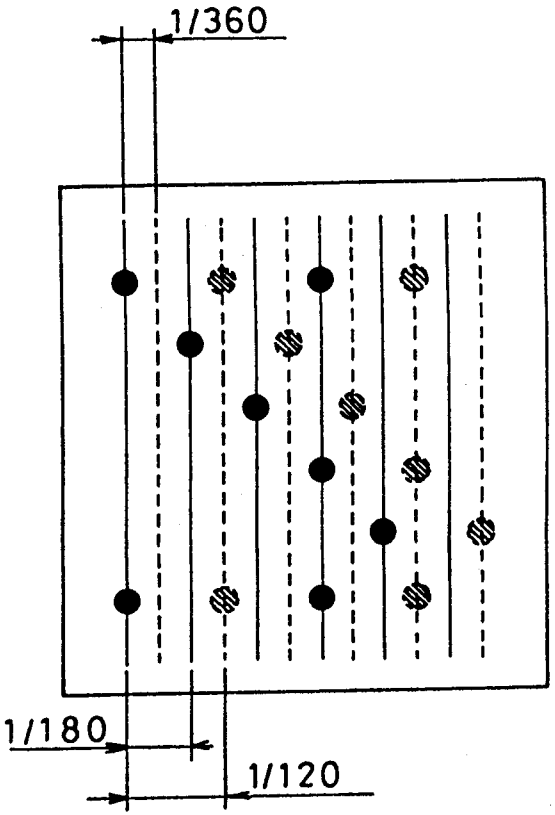
FIG.4 ( b )
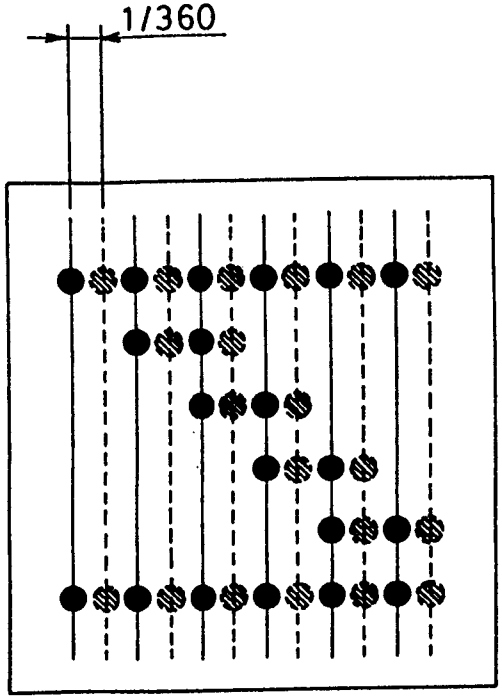
FIG.4 ( a )
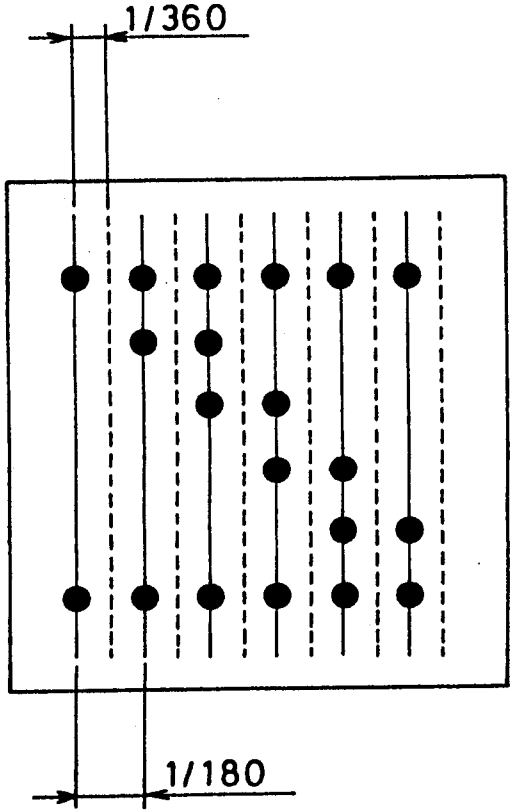

DOT PRINTER WITH CHANGEABLE QUALITY DOT PATTERN

BACKGROUND OF THE INVENTION

1. Field of the Invention

The present invention relates to a dot printer capable of producing dot patterns representing characters, symbols and patterns and of printing the dot patterns on a recording medium.

2. Description of the Related Art

A conventional dot-matrix printer is provided with a print head having a plurality of print wires arranged in a single vertical line and a carriage for moving the print head in a printing direction at a predetermined speed. The print wires are driven selectively according to input data specifying basic dot patterns as the print head is moved at a predetermined speed to print characters and patterns in dot matrices of a predetermined size.

The operating speed of the print wires, namely, the response frequency of the print head, of such a dot-matrix printer is adjusted to a predetermined speed so that dots may be printed accurately at a predetermined pitch with respect to a direction along the line while the carriage moves at a normal speed. Therefore, when the carriage moves at a speed higher than the normal speed for high-speed printing, the pitch of the dots is increased and thereby basic dot patterns are expanded in the direction of the dot line.

Accordingly, dot patterns of a dot density less than that of the basic dot patterns are produced for high-speed printing as a result of omitting every other dot of each dot line of successive dots producing thinned-out dot patterns that are printed during high printing speed, such as twice the normal printing speed (FIG. 5). The result is printed patterns having a thinned-out, or less dense, dot matrix but having the same height and width as those of the basic dot matrix. However, the dot pitch of the thinned-out dot matrix printed at the high printing speed is 1/90 in. whereas the dot pitch of the basic dot matrix printed at the normal printing speed is 1/180 in.

Even when a straight line extending along the direction of the dot line is printed at the high printing speed by omitting every other dot, the deterioration in print quality is insignificant because the thickness of the line, i.e., the size perpendicular to the direction of the dot line, corresponds to the width of the dot and the dot has a fixed size. However, print quality of an oblique or vertical line is deteriorated significantly when the oblique line or the vertical line is printed at the high printing speed. In the thinned-out dot matrix the width of the oblique line or the vertical line is reduced by half. Thus, the conventional dot printer has been unable to print with a satisfactory print quality.

Naturally, the deterioration of print quality may be suppressed by using dot patterns prepared specially for high-speed printing. However, to do so requires dot pattern memories, such as font ROMs for storing both the standard dot patterns and the special dot patterns for high-speed printing and other system components associated with the dot pattern memories.

SUMMARY OF THE INVENTION

Accordingly, it is an object of the present invention to provide a dot printer capable of printing dot patterns of a satisfactory print quality at any of a plurality of printing speeds without using previously stored special dot patterns for printing at the different printing speeds.

In one aspect of the present invention, the dot printer comprises: a print head, print head moving means for laterally reciprocating the print head relative to a recording medium; print head driving means for driving the print head; storage means for storing predetermined basic dot patterns; and printing operation control means for reading the basic dot pattern corresponding to input data given thereto, producing a printing dot pattern on the basis of the basic dot pattern, and controlling the print head moving means and the print head driving means according to the printing dot pattern to print the input data on a recording medium; wherein the printing operation control means comprises: reference dot pattern producing means for producing a reference dot pattern by replicating each column continuously n times wherein the arrangement of the replicated columns is the same as that of the basic dot pattern; and printing dot pattern producing means for producing a printing dot pattern on the basis of the reference dot pattern by omitting m dots following the head dot of a continuous dots row in each line of the reference dot pattern, including the next dot, omitting the next m dots and so on until the line is complete for the printing dot pattern.

The reference dot pattern producing means adjusts the arrangement of the dots of the basic dot pattern read from the storage means to produce a reference dot pattern. The printing dot pattern producing means omits some of the dots of each dot line of the reference dot pattern to produce a printing dot pattern. The printing operation control means controls the print head driving means according to the printing dot pattern produced by the printing dot pattern producing means to print data on a recording medium.

Thus, the dot printer in accordance with the present invention does not need to store special dot patterns for printing at each of a plurality of different printing speeds and is capable of high quality printing at any of the print speeds.

BRIEF DESCRIPTION OF THE DRAWINGS

A dot printer in a preferred embodiment according to the present invention will be described in detail with reference to the accompanying drawings, wherein:

FIGS. 4(*a*), 4(*b*) and 4(*c*) are diagrams portraying dot patterns; and

DESCRIPTION OF THE PREFERRED EMBODIMENT

Figure 1:
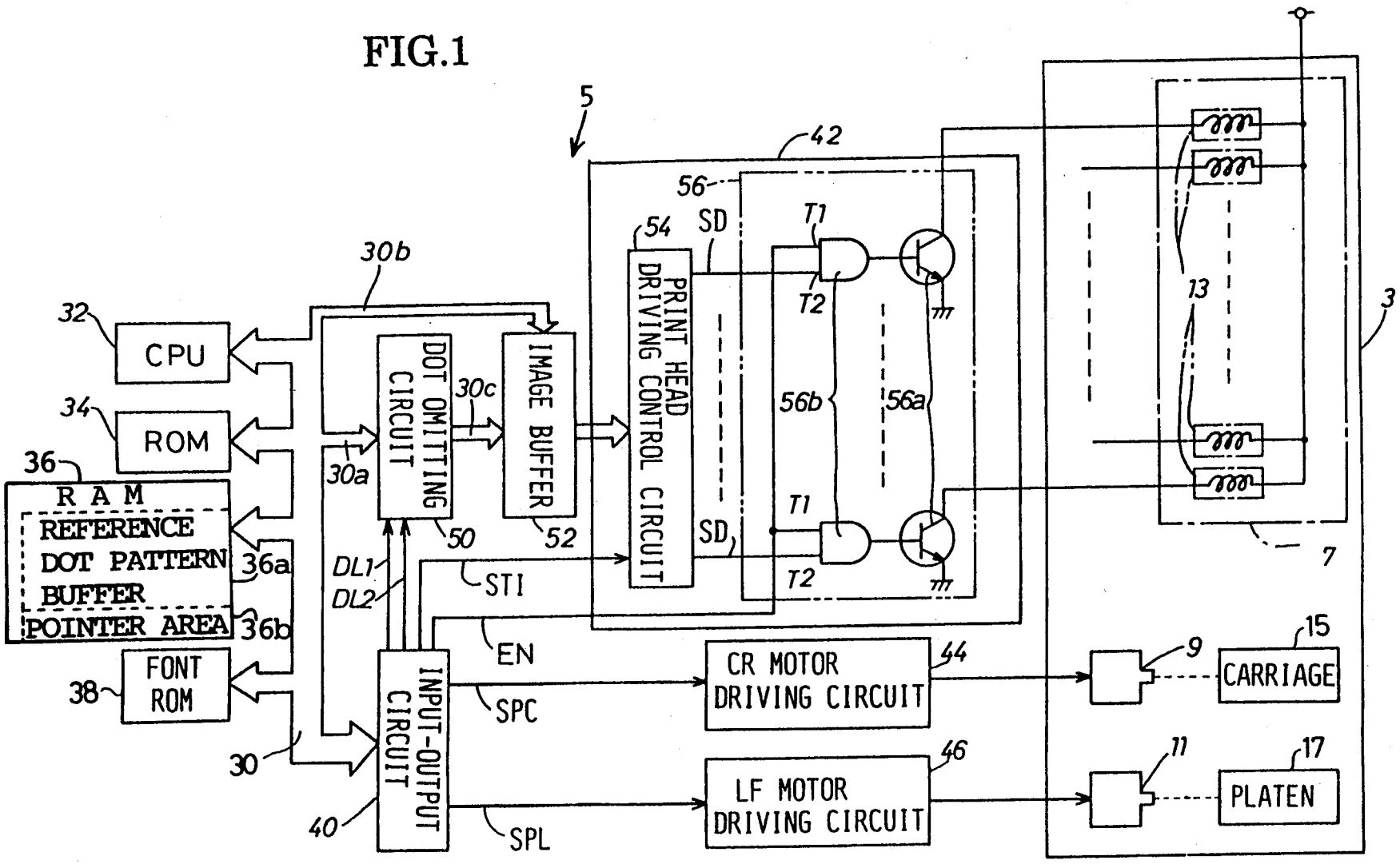
FIG. 1 is a block diagram of an electrical system incorporated into a dot printer in a preferred embodiment according to the present invention.

Referring to FIG. 1, a dot printer embodying the present invention is similar to a generally known serial wire impact dot-matrix printer disclosed in U.S. Pat. No. 4,653,940. The dot printer comprises, as principal components, a printing unit 3 and an electronic control unit 5.

The printing unit 3 comprises a carriage 15, a print head 7 mounted on the carriage 15, a stepping motor (hereinafter referred to as "CR motor") 9, a platen 17 and a stepping motor (hereinafter referred to as "LF motor") 11. The mechanical construction of the printing unit 3 is similar to that of a generally known printing unit, and hence the description thereof will be omitted. The print head 7 comprises a parallel, vertical, linear arrangement (or parallel, vertical zigzag arrangement) of print wires, and solenoids for driving each of the print wires for printing. The solenoids 13 are controlled by a print head driving circuit 42 included in the electronic control unit 5. The electronic control unit 5 comprises a common bus 30, a data bus 30*a* and an address bus 30*b* branched from the common bus 30, a dot omitting circuit 50 connected to the data bus 30*a* and control lines (not shown), and an image buffer 52 connected to the address bus 30*b* and control lines (not shown) in addition to the dot omitting circuit 50 by a data bus 30*c*. In this embodiment, a font ROM 38 and the dot omitting circuit 50 correspond respectively to the storage means and the printing dot pattern producing means. A ROM 34 stores control programs, CR motor excitation timing data (pulse rate) for timing the excitation of the CR motor 9, and solenoid energizing time data for controlling the energizing of the solenoids 13. A work area for storing various initialization data executed when the dot printer is turned on, a reference dot pattern buffer 36*a* for storing printing dot pattern, and a pointer area 36*b* are set in a RAM 36. A read pointer P1 and a write pointer P2 are set in the pointer area 36*b*. Basic patterns representing various characters and patterns are stored in the font ROM 38. For example, when a basic dot pattern is formed by a 24×24 dot matrix, column data of one column is constructed by 24 dots (three bytes) and dot pattern data for one character or one pattern is constructed by 24 columns. The column data and the dot pattern data are stored in predetermined areas in the font ROM 38.

The print head driving circuit 42 comprises a print head driving control circuit 54 and a power supply circuit 56. The power supply circuit 56 comprises power transistors 56*a* connected respectively to the solenoids 13, and AND gates 56*b* connected respectively to the base terminals of the power transistors 56*a*.

The print head driving control circuit 54 reads a printing dot pattern, which will be described afterward, from the image buffer 52 every stepping movement of the print head 7 synchronous with the stepping motion of the CR motor upon the reception of a timing signal STI from the input-output circuit 40, and then gives a high-level dot recording signal Sd (active) corresponding to the printing dot pattern to the AND gates 56*b*.

The power supply circuit 56 supplies power selectively to the solenoids 13 for a predetermined time every stepping movement of the print head 7 to print a pattern according to the condition of the AND gates 56*b*, each of which has one input terminal T1 to receive a power supply command signal EN from the input-output circuit 40 and a second input terminal T2 to receive a dot recording signal Sd from the image buffer 52. Power is supplied for every stepping movement of the print head 7 and is repeated a predetermined number of times to print a character or pattern in a dot matrix of a predetermined size, such as a 24×24 dot matrix.

The CR motor driving circuit 44 supplies power to the coils of different phases of the CR motor 9 according to a predetermined sequence, such as two-phase excitation method, in synchronization with a pulse signal SPC provided by the input-output circuit 40. That is, the input-output circuit 40 produces a pulse signal SPC at a pulse rate for the normal printing speed or for a high printing speed on the basis of the excitation timing data read from the ROM 34, and then the CR motor driving circuit 44 drives the CR motor 9 in synchronization with the pulse signal SPC for the normal printing speed or the high printing speed. For example, the print head 7 prints dots successively in the direction of the line at a pitch of 1/180 in. when the CR motor is driven for the normal printing speed or at a pitch of 1/120 in. when the CR motor is driven at the high printing speed. The LF motor driving circuit 46 drives the LF motor 11 according to a pulse signal SPL provided by the input-output circuit 40.

Figure 2:
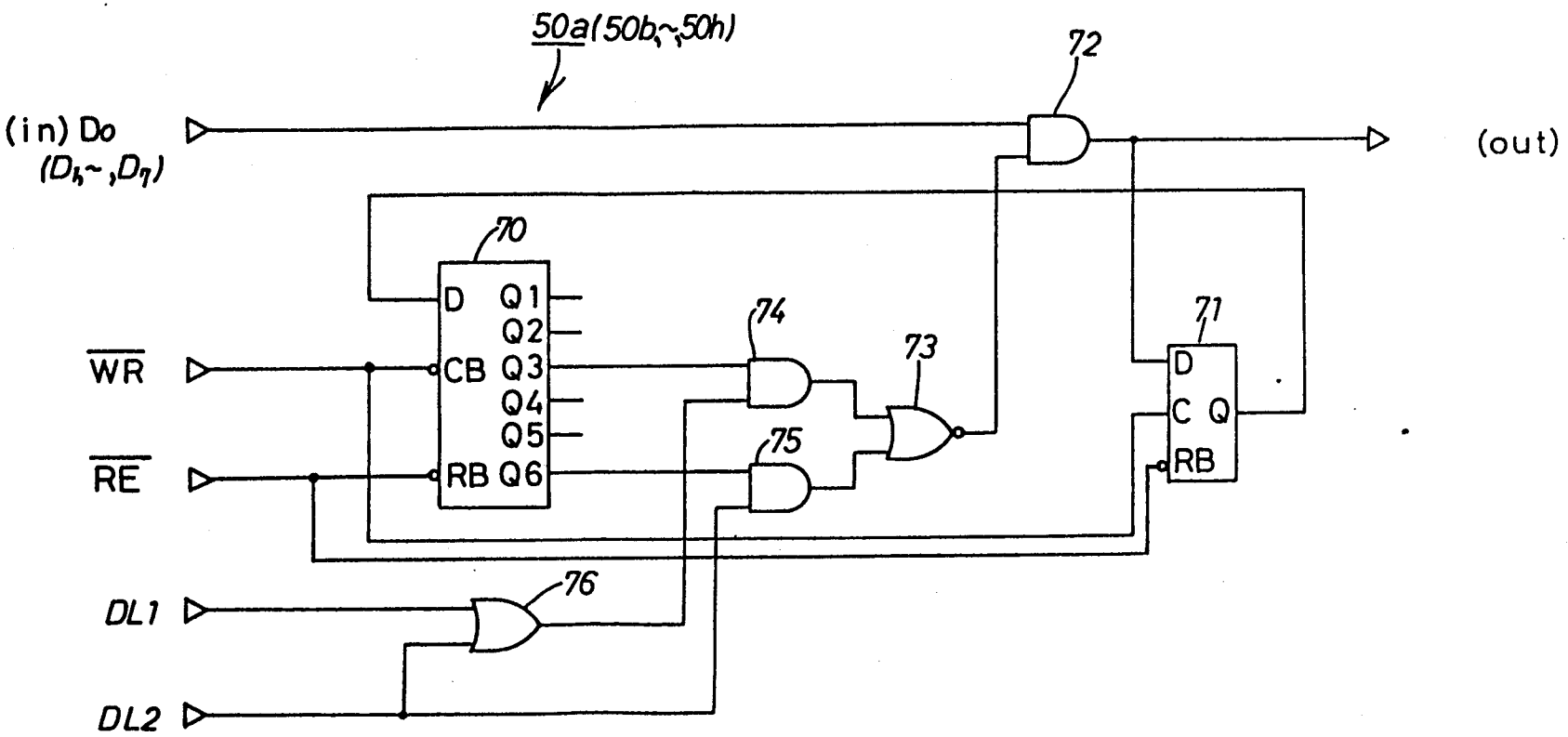
FIG. 2 is an electric circuit diagram of a dot omitting circuit.

As shown in FIG. 2, the dot omitting circuit 50 is a gate array of eight circuit units 50*a* to 50*h* each comprising a shift register 70, a D type flip flop 71 and logic elements 72 to 76. The circuit units 50*a* to 50*h* correspond respectively to data D0 to D7 used to define a 24 dot vertical line of the dot pattern in three groups of eight bits each. The circuit units 50*a* to 50*h* provide low-level dot non-recording data signals a predetermined number of times even if the preceding bit of input data in a given dot row was dot recording data and when the input data given thereafter are successive high-level dot recording data.

A reference dot pattern producing procedure to be executed by the electronic control unit 5 thus constructed will be described hereinafter with reference to a flow chart shown in FIG. 3.

Figure 3:
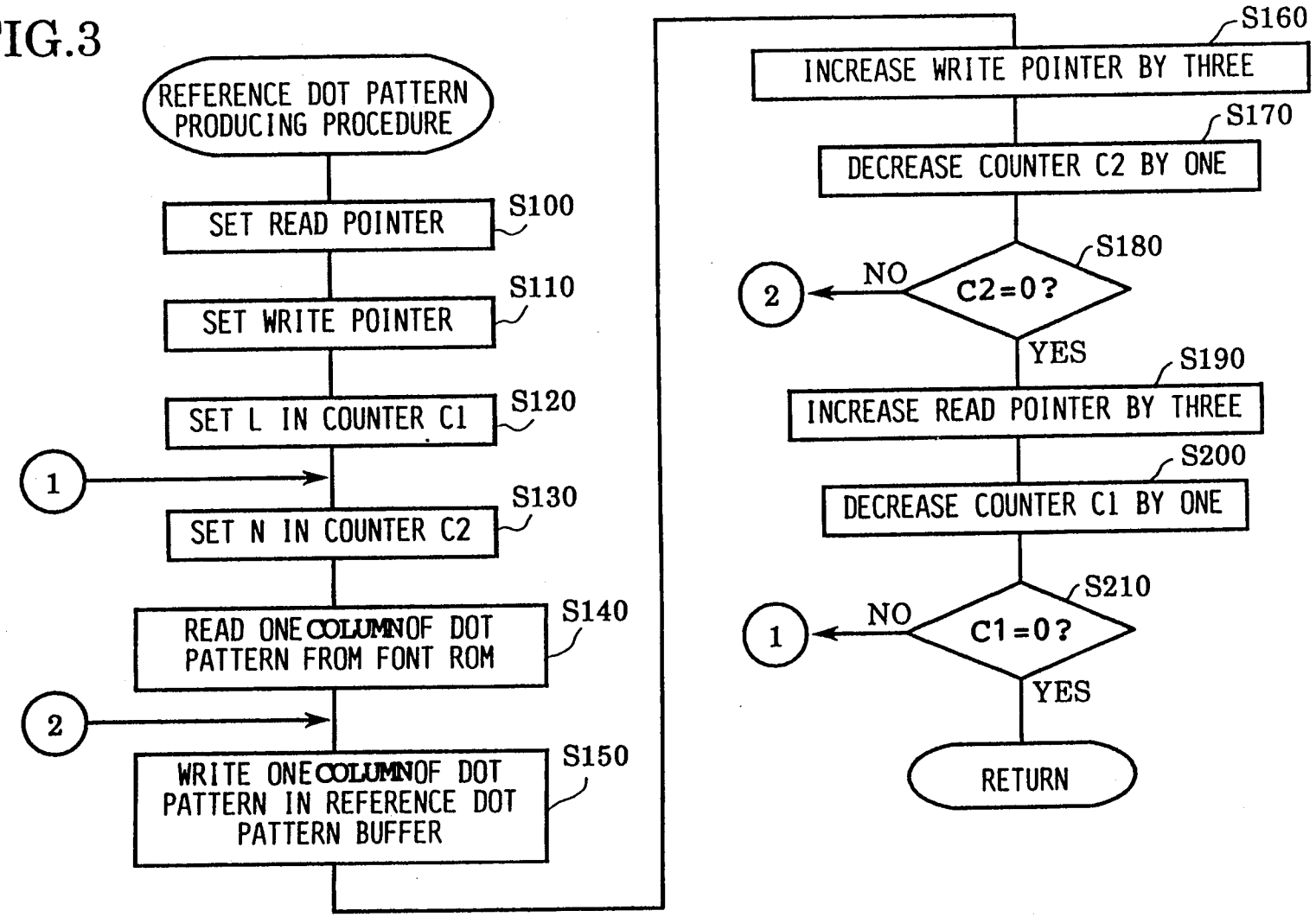
FIG. 3 is a flow chart of a reference dot pattern producing procedure.
Figure 5:
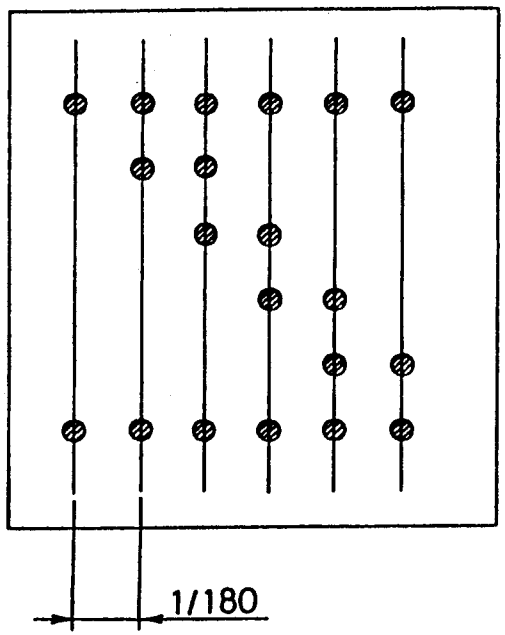
FIG.5 (a) ( PRIOR ART )
FIGS. 5(*a*) and 5(*b*) are diagrams portraying a conventional dot pattern.
Figure 5:
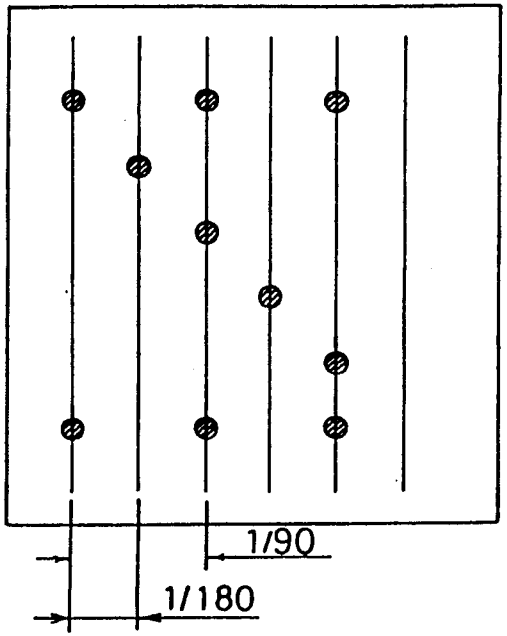
FIG.5 (b) ( PRIOR ART )

Upon reception of a high-speed printing command signal from a host computer (not shown), the electronic control unit 5 starts a reference dot pattern producing procedure according to a control program shown in FIG. 3. In step S100, the head address in the font ROM 38, storing reference dot patterns, corresponding print data is set as a read pointer P1, and then the head address for a predetermined area of the reference dot pattern buffer 36*a* storing reference dot patterns is set as a write pointer P2 in step S110. In step S120, a counter C1, for counting the number of columns, is set for the number L. L is the total number of columns of a predetermined dot matrix. In this embodiment, the size of the dot matrix is 24×24, so the number L is "24". In step S130, a counter C2 for counting the number of write cycles is set for a predetermined number n. In this embodiment, dot density with respect to the direction of the line is doubled to produce reference dot patterns so that n=2. In step S140, data stored in three locations of the font ROM 38 specified by the read pointer P1, i.e., three-byte data of one column, is read and, in step S150, the data read from the font ROM 38 is written in three locations in the reference dot pattern buffer 36*a* specified by the write pointer P2. In step S160, the write pointer P2 is increased by three and, in step S170, the count of the counter C2 is decreased by one.

In step S180, a query is made to see if the count of the counter C2 is zero. When the response is negative, the program returns to step S150 to write sequentially three-byte data of one column of an address in the reference dot pattern buffer 36*a* specified by the write pointer P2. When the response in step S180 is affirmative, namely, the count of the counter C2 is zero, the read pointer P1 is increased by three in step S190, the count of the counter C1 is decreased by one in step S200, and then step S210 is executed.

In step S210, a query is made to see if the count of the counter C1 is zero. When the response in step S210 is negative the program returns to step S130 and, when the response in step S210 is affirmative, the program is ended.

Thus, a reference dot pattern as shown in FIG. 4(*b*) is produced by arranging an additional vertical line of dots of an arrangement the same as those of the dots of each vertical line of the basic dot pattern shown in FIG. 4(*a*) so that the dots of vertical line of the basic dot pattern and those of the additional vertical line are arranged alternately in a line. As stated above, the reference dot patterns thus produced are stored sequentially in the reference dot pattern buffer 36*a*.

Then, the dot omitting circuit 50 omits a predetermined number m of successive dots, for example, two successive dots (m=2), from each group of a predetermined number of successive dots, for example, three successive dots, of each dot line of the reference dot pattern to produce a printing dot pattern as shown in FIG. 4(*c*). The printing dot patterns thus produced are stored sequentially at a predetermined address in the image buffer 52. Only a portion of a dot matrix of a predetermined size is shown in FIGS. 4(*a*), 4(*b*) and 4(*c*).

A printing dot pattern producing procedure will be described hereinafter with reference to FIGS. 2 and 3. In the printing dot pattern producing procedure, the reference dot pattern is read from the reference dot pattern buffer 36*a*, and then some of the dots of the reference dot pattern are omitted to obtain a printing dot pattern.

The shift register 70 and the D type flip flop 71 of each of the circuit units 50*a* to 50*h* are reset by a reset signal RE (low level, active) in initialization. Therefore, the output signals appearing at the output terminals Q1 to Q6 of the shift register 70, and the output terminal Q of the D type flip flop 71 go low level. In producing a printing dot pattern as shown in FIG. 4(*c*) by omitting two successive dots of each arrangement of three successive dots, the input-output circuit 40 gives a high-level two-dot omission command signal DL2 (active) to the circuit units 50*a* to 50*h*. The reference dot pattern buffer 36*a* gives 8-bit data D0 to D7 of the first to eighth rows of the first vertical line (or column) of the reference dot pattern to the AND gates 72 of the corresponding circuit units 50*a* to 50*h*. Upon the stabilization of the data on the data bus 30*a*, the CPU 32 gives a first write signal WR (low level, active) to each shift register 70. Consequently, a signal on the Q terminal of the flip flop 71 applied to the D terminal of the shift register 70 appears at the Q1 terminal of the shift register 70. Since the shift register 70 and the flip flop 71 have been reset by the reset signal RE, low-level signals appear at the Q3 and Q6 terminals of the shift register 70. Consequently, the AND gate 72 opens to store the data D0 to D7 applied to the circuit units 50*a* to 50*h* in the image buffer 52 without changing the signal level. The 8-bit data of the ninth to sixteenth rows of the first vertical line of the reference dot pattern are applied to the AND gates 72 of the corresponding circuit units 50*a* to 50*h*. Upon the application of the second write signal WR to each shift resister 70 by the CPU 32, data provided by the AND gates 72 are stored in the image buffer 52.

The 8-bit data of the seventeenth to twenty-fourth rows of the first vertical line of the reference dot pattern are processed in the same procedure, and data provided by the AND gates 72 are stored in the image buffer 52.

The data of the second vertical line of the reference dot pattern are processed eight bits at a time by the circuit units 50*a* to 50*h* and data provided by the AND gates 72 are stored in the image buffer 52. The data of the third vertical line and the following vertical lines are processed similarly and data provided by the AND gates 72 are stored sequentially in the image buffer 52.

Accordingly, when high-level data, namely, printing dot data, is provided by the AND gate 72, a high-level signal appears at the terminal Q3 or Q6 of the shift register 70 and a low-level signal is provided by a NOR gate 73 in the third and sixth data processing cycles from the next data processing cycle and, consequently, the AND gate 72 closes. Therefore, a low-level signal, namely, dot omission data, is provided. Thus, the dot omitting circuit 50 produces a printing dot pattern as shown in FIG. 4(*c*) having voids each corresponding to two or more dots formed on the opposite sides of each dot with respect to the direction of the row.

When the input-output circuit 40 provides a one-dot omission signal DL1 (high level, active), an AND gate 74 remains open and an AND gate 75 remains closed. Therefore, when the AND gate 72 provides high-level data, a high-level signal appears at the output terminal of the shift register 70 only in the third data processing cycle from the next data processing cycle. Therefore, the NOR gate 73 provides a low-level signal and the AND gate 72 closes. Consequently, a printing dot pattern thus produced has voids each corresponding to one or more dots on the opposite sides of each dot with respect to the direction of the row.

Upon the reception of the write signal WR from the CPU 32, the image buffer 52 stores the data received from the dot omitting circuit 50 at an address specified by the CPU 32. That is, the printing dot pattern produced by thus omitting some of the dots of the reference dot pattern by the dot omitting circuit 50 is stored at the specified address in the image buffer 52 by the operation of the CPU 32 for storing the reference dot pattern, as stored in the reference dot pattern buffer 36*a*, in the image buffer 52.

When the printing dot pattern thus produced is printed at a high printing speed, for example, a printing speed 1.5 times the normal printing speed, the printing dot pattern is printed in a dot matrix having a height and a width the same as those of the original dot matrix for printing at the normal printing speed, respectively, and a dot pitch 1.5 times the dot pitch of the original dot matrix, for example, $1.5 \times 1/180$ in. $= 1/120$ in. That is, as shown in FIG. 4(*c*), straight lines extending along the direction of the dot line (hereinafter referred to as "horizontal lines") are formed of successive dots arranged at a pitch of 1/120 in. Accordingly, oblique lines or straight lines extending along the direction of the column, or vertical lines, have a width corresponding to two dots, which is the same as that of vertical lines of the basic dot pattern.

As is apparent from the foregoing description, according to the present invention, a basic dot pattern is processed to provide a reference dot pattern having a dot density with respect to the direction of the dot line twice that of the basic dot pattern. Subsequently, a printing dot pattern is produced by omitting two successive dots after the head dot of a successive arrangement of dots of each line of dots of the reference dot pattern, and the printing dot pattern is printed at a high printing speed. Accordingly, oblique lines and vertical lines can be printed at the high printing speed having satisfactorily high print quality and without thinning. Particularly, the Ming style characters having comparatively thick vertical lines and oblique lines as compared with horizontal lines can be printed at a high printing speed with a satisfactory print quality without requiring special dot patterns for high-speed printing.

The dot printer in the foregoing embodiment stores a reference dot pattern produced by adjusting the dot arrangement of a basic dot pattern in the reference dot pattern buffer 36a of the RAM 36, and then omits some of the dots of the reference dot pattern by the dot omitting circuit 50 to produce a printing dot pattern. However, the printing dot pattern may also be produced by directly providing data representing the rows of dots of the basic dot pattern read from the font ROM 38 and by sequentially storing dot data provided by the dot omitting circuit 50 in the image buffer 52. In such a case, the data representing the same row of dots must be given repeatedly a predetermined number of times in the dot omitting circuit 50. The dot omitting operation of the dot omitting circuit 50 may be substituted by a control program, which eliminates the hardware, such as the dot omitting circuit 50, to simply the circuit configuration of the electronic control unit 5.

What is claimed is:

1. A dot printer comprising:

a print head for printing input data on a recording medium;

a print head moving means for laterally reciprocating the print head relative to the recording medium at a normal speed and a fast speed;

a print head driving means for driving the print head;

a storage means for storing predetermined basic dot patterns; and a printing operation control means for reading the basic dot pattern corresponding to input data, producing a printing dot pattern on the basis of the basic dot pattern stored in the storage means, and controlling the print head moving means and the print head driving means according to the printing dot pattern to print the input data on the recording medium at a normal speed using the basic dot pattern as the printing dot pattern;

wherein the printing operation control means comprises:

a reference dot pattern producing means for producing a reference dot pattern by replicating each column continuously n times wherein an arrangement of the replicated columns is the same as that of the basic dot pattern; and a printing dot pattern producing means for producing a printing dot pattern, for printing during fast speed movement of the print head, on the basis of the reference dot pattern by omitting m dots after a head dot and after remaining successive dots of a continuous dot row of the reference dot pattern to create a printing dot pattern comprising continuous dot rows of alternating printed dots having gaps therebetween as a result of the m omitted dots, m and n being positive integers.

2. The dot printer according to claim 1, wherein said printing dot pattern producing means includes an omitting circuit comprising:

a shift register; and a D type flip flop.

3. A dot printer having a print head and print head drive means for powering and moving the print head reciprocatingly along a print line at one of a normal speed and a fast speed, the dot printer further comprising:

a storage means for storing predetermined basic dot patterns; and a printing operations control means for reading the basic dot pattern according to input data and controlling printing to print said input data using the basic dot pattern during normal speed printing whereas for fast speed printing, the printing operations control means uses the basic dot pattern to produce a printing dot pattern that replicates in an offset manner the basic dot pattern r times, r being a positive integer, to create an increased density pattern and subsequently during high speed printing starting at a head dot in each horizontal line of dots, an alternating sequence of x dots are printed and y dots are skipped, x and y being positive integers, as contained in the printing proportions during fast speed printing as during normal printing.

4. A dot printer as claimed in claim 3 wherein r equals one and the replicated pattern is offset one-half the distance between two adjacent dots in a horizontal line of dots of the basic dot pattern.

5. A dot printer as claimed in claim 3, wherein x equals one and y equals two.

6. A dot printer as claimed in claim 3, wherein each replicated pattern is offset $1/1+r$ the distance from a proceeding dot in a dot line until a spacing equal to the distance between two successive dots in the dot line of the basic dot pattern has been filled by the r replicates.

7. A dot printer as claimed in claim 3, wherein x equals one and y is a function of print speed.

* * * * *